United States Patent [19]

Munro

[11] Patent Number: 4,718,336

[45] Date of Patent: Jan. 12, 1988

[54] MODULAR AUTOMATIC BALE TIER

[75] Inventor: Robert A. Munro, Holland, Pa.

[73] Assignee: Cives Corp., Roswell, Ga.

[21] Appl. No.: 921,974

[22] Filed: Oct. 22, 1986

[51] Int. Cl.[4] ..... B65B 13/28

[52] U.S. Cl. ..... 100/3; 100/31; 100/11; 100/98 R

[58] Field of Search ..... 100/2, 3, 11, 31, 19, 100/20, 21, 98 R

[56] References Cited

U.S. PATENT DOCUMENTS

| | | | |
|---|---|---|---|
| 3,528,364 | 9/1970 | Freund | 100/11 |
| 3,587,448 | 6/1971 | Hemphill | 100/3 |
| 3,916,778 | 11/1975 | Van Doorn et al. | 100/4 |
| 3,918,358 | 11/1975 | Burford | 100/31 X |
| 3,929,062 | 12/1975 | Thompson | 100/3 |
| 3,949,662 | 4/1976 | Woomer | 100/4 |
| 3,999,476 | 12/1976 | Thompson | 100/7 |
| 4,088,068 | 5/1978 | White et al. | 100/3 |
| 4,090,440 | 5/1978 | Jensen | 100/4 |
| 4,150,613 | 4/1979 | Smee et al. | 100/3 |
| 4,158,994 | 6/1979 | Jensen | 100/3 |
| 4,324,176 | 4/1982 | McCormick | 100/3 |
| 4,459,904 | 7/1984 | Probst et al. | 100/31 X |
| 4,466,345 | 8/1984 | Kaldenbach | 100/3 X |
| 4,483,245 | 11/1984 | Fetters | 100/7 |

OTHER PUBLICATIONS

Gerrard Tennant "Twistlock" (flyer).

Generation III, USS Packaging Systems (general catalog).

"AMBACP Balers are More Dependable . . . ", The American Baler Company (brochure).

*Primary Examiner*—Andrew M. Falik

*Attorney, Agent, or Firm*—Seidel, Gonda, Goldhammer & Abbott

[57] ABSTRACT

A modular automatic bale tier for separately tying one or more wires each in a closed loop having an adjustable predetermined length about a compacted bale of material so as to eliminate wire breakage and slack due to variations in bale material, density and dimensions. Each closed loop is formed by engagement of opposite portions of the wire by a reciprocating wire transport head which brings the portions together for the twisting and cutting operations.

25 Claims, 19 Drawing Figures

MODULAR AUTOMATIC BALE TIER

BACKGROUND OF THE INVENTION

The present invention is directed generally to a bale tier for horizontal extrusion balers and horizontal closed chamber balers. More particularly, the invention is directed to an automatic bale tier or strapper for tying one or more wires around a bale of compacted material. Automatic balers and bale tiers are well-known in the art. For example, U.S. Pat. No. 3,528,364 discloses an automatic bale tier for an extrusion baler including a vertical column of wire transport heads, each head being provided with rollers and a "V" wire guide. See FIG. 8. The heads are driven simultaneously by a single cylinder piston. The cylinder piston extends the heads through ports in a compaction ram, from one side of the machine to an opposite side wherein rack and pinion type twisters and guillotine cutters are located. In U.S. Pat. Nos. 3,929,062 and 3,999,476, there is disclosed a baler wherein wires are separately tied, in sequence, to the same bale. The wires are fed by a vertically movable strapping mechanism 30 through vertically movable wire tracks which align with track segments in the face of the compaction ram and in a chamber discharge gate.

In a horizontal extrusion baler, such as that disclosed in U.S. Pat. No. 3,528,364, material to be compacted is fed to a hopper. A compaction ram is repeatedly reciprocated so as to compress the material into a bale. The nature of the compacting process is such that the density and dimensions of the bale are not uniform. The bale tends to be more dense along its bottom portion and less dense along its top portion. A perimeter line defined by a horizontal plane intersecting the bale tends to be shorter at the top portion of the bale and longer at the bottom portion. Where multiple wires are to be tied around the bale, a wire loop surrounding a denser portion of the bale should have a longer length than a wire loop surrounding a less dense portion of the bale.

Also, certain materials such as cardboard have greater hysteresis or memory, i.e., ability to rebound after deformation, than other materials such as paper. Bales formed from higher hysteresis materials, if tied too tightly, can exert enough pressure on a wire loop to break the loop twist joints. In comparison, bales formed of lesser hysteresis materials can be tied more tightly without danger of breakage of the loop twist joints. Thus, the lengths of the wire loops which tie or bind a bale should be variable based on the type of material from which the bale is formed.

Prior art automatic bale tiers such as that disclosed in U.S. Pat. No. 3,528,364 tie one or more wires in closed loops around the bale such that the closed loops are equal in length and do not vary from bale to bale. Accordingly, these bale tiers do not account for variations in materials, density and dimension of the bale. If the wires are tied in closed loops having identical lengths, there will either be slack in the wire loop surrounding the least dense portion of the bale in which case the wire loop may work loose from the bale, or excessive tension in the wire loop surrounding the densest portion of the bale in which case the wire loop is susceptible to breakage. Similarly, if the lengths of the wire loops do not vary from bale to bale, to account for different material properties, bales made from higher hysteresis materials may break the loop twist joints.

The problem solved by the present invention is that of automatically tying a bale with multiple wire loops having separately adjustable, pre-determined lengths to match the variations in materials, density and dimensions of the bale thereby eliminating breakage or slack in the wire loops.

BRIEF SUMMARY OF THE INVENTION

Apparatus for tying bales of compacted material, comprising a frame, a module mounted on one side of the frame, and means for adjustably positioning the module in either of two directions with respect to the frame. The module includes a wire transport head movable between a first position adjacent one side of the frame and a second position adjacent an opposite side of the frame. A wire has a first portion which traverses a zone at the first position and a second portion which traverses a zone at the second position. The apparatus includes means for reciprocating the head between the first and second positions such that the head moves from the first position to the second position without engaging either wire portion and moves from the second position back to the first position while engaging both wire portions, and means for twisting and cutting both wire portions when the wire transport head has returned to the first position so as to form a closed wire loop around the bale.

DETAILED DESCRIPTION OF THE INVENTION

Figure 1:
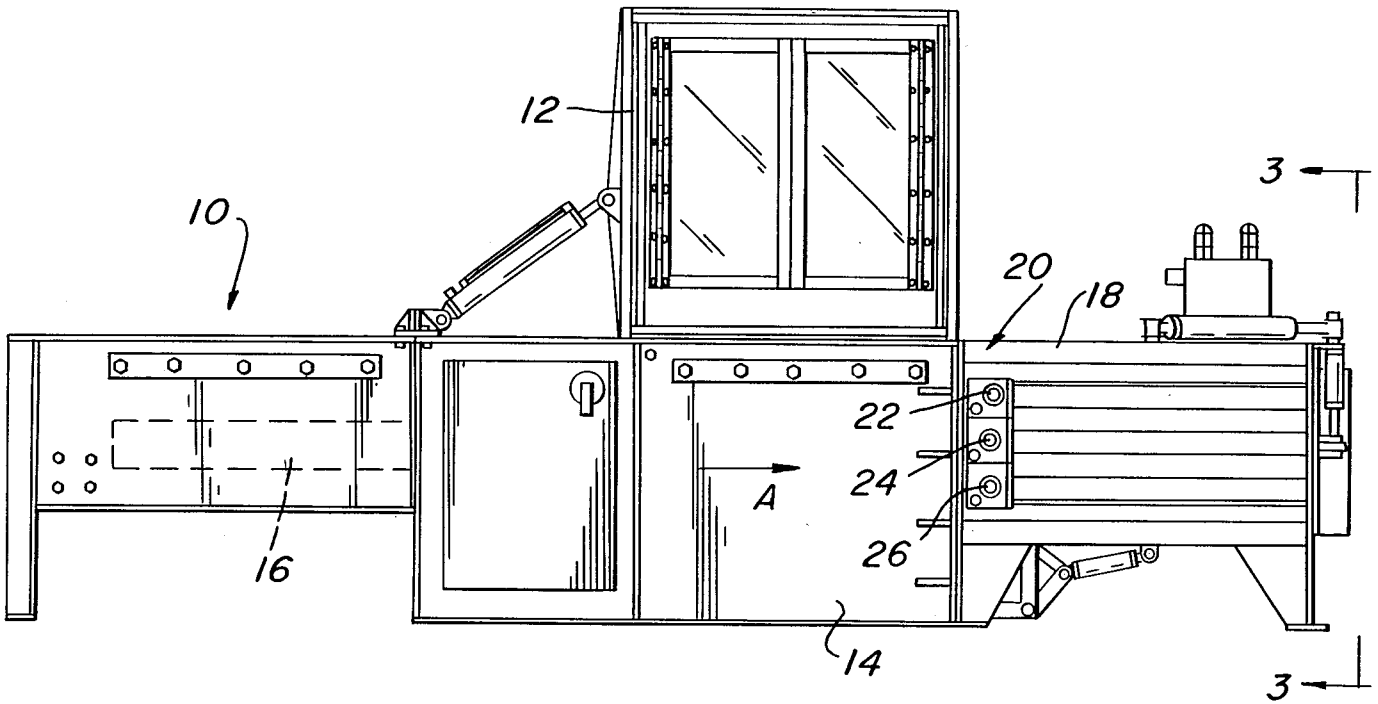
FIG. 1 is a side elevation of a horizontal extrusion baler including the bale tier of the present invention.
Figure 2:
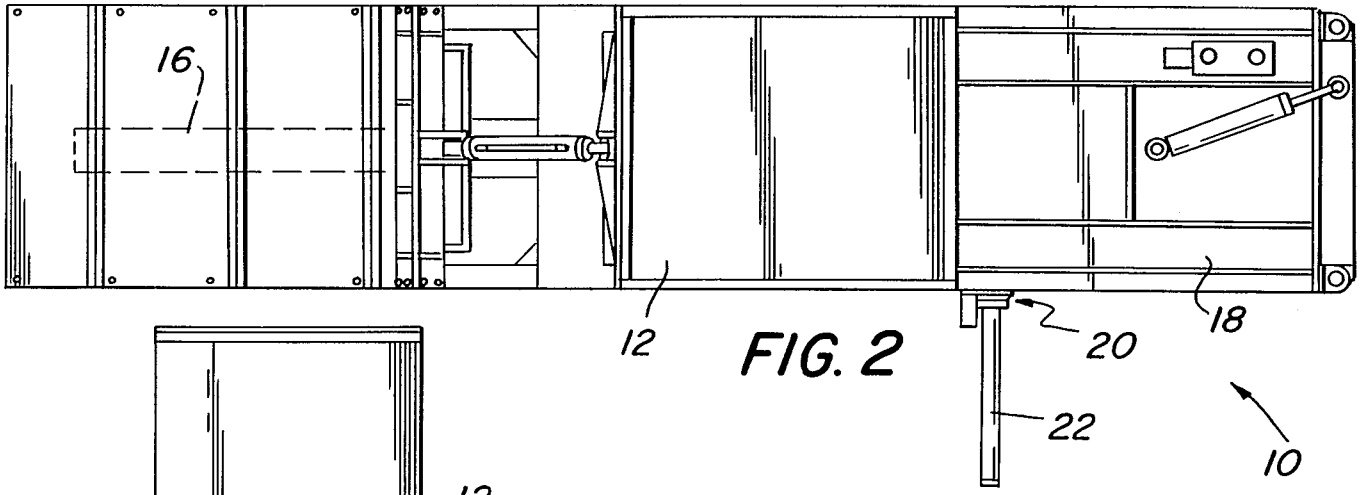
FIG. 2 is a top plan view of the baler shown in FIG. 1.
Figure 3:
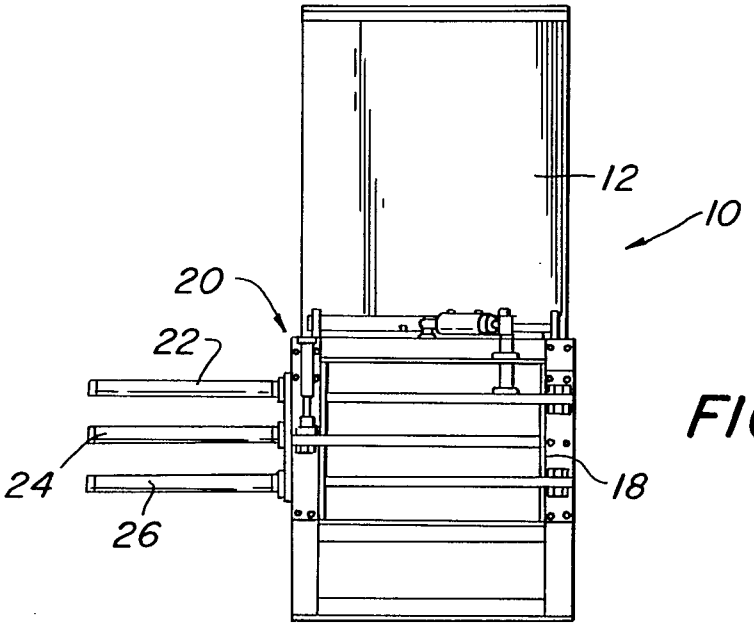
FIG. 3 is a side elevation taken along 3—3 in FIG. 1.
Figure 4:
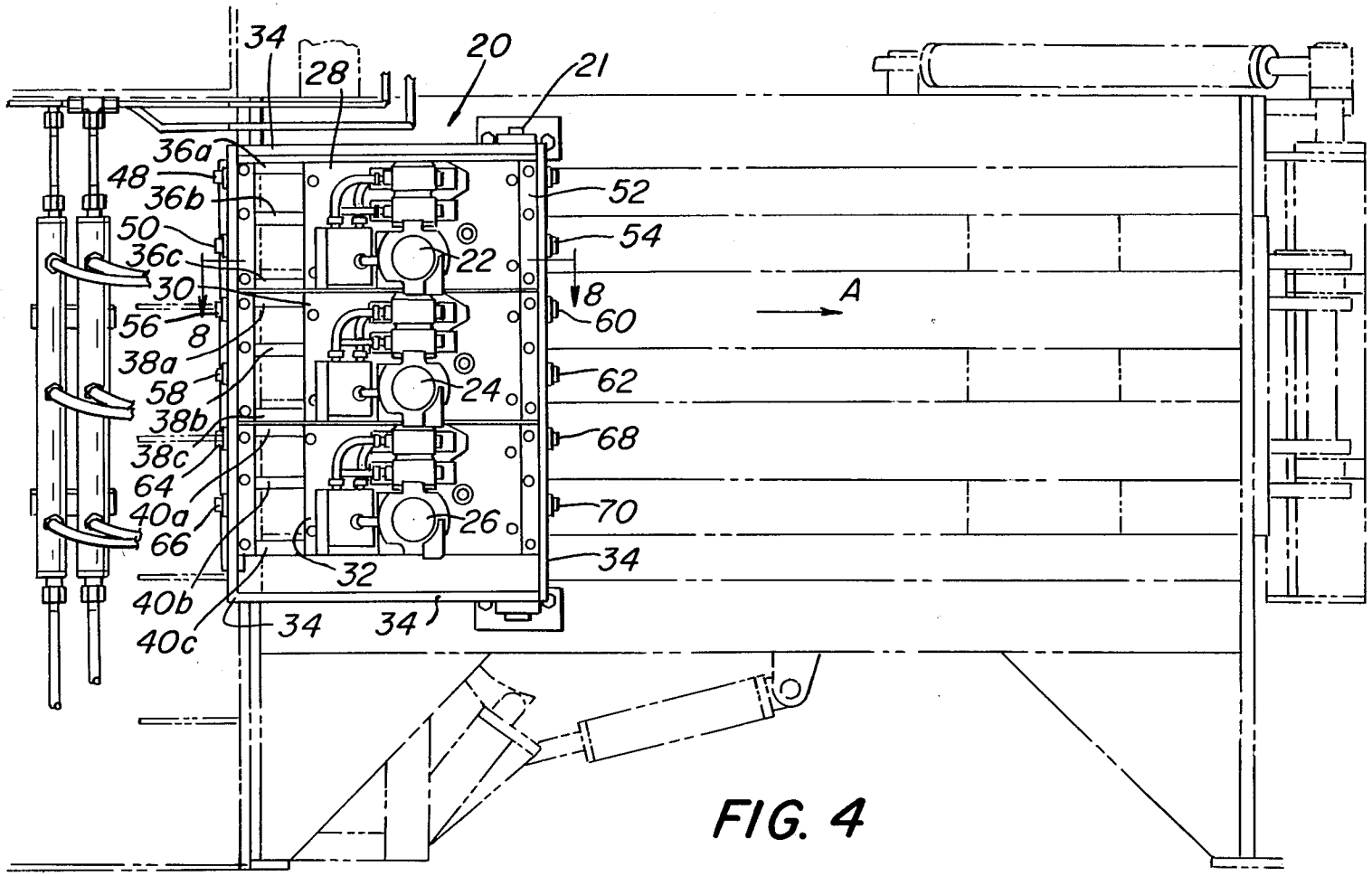
FIG. 4 is an enlarged side elevation of the bale tier of the present invention.

Referring to the drawings, wherein like numerals indicate like elements, there is shown in FIG. 1 a horizontal extrusion baler designated generally as 10. Shredded or other material to be compacted is fed to a hopper 12 and collected in a chamber 14. A compaction ram 16 is repeatedly operated as described in U.S. Pat. No.

3,528,364 to compress the material collected in chamber 14. The ram 16 pushes the material in the direction A into a baling chamber 18. The material being compacted is pushed by the ram 16 against multiple vertically-spaced wires, straps or ties (hereinafter generally referred to as wires) which traverse the baling chamber as described in U.S. Pat. No. 3,528,364. Wire is paid out from two wire supply spools located upstream of the baling chamber 18. Thus, there are two such spools for each wire loop. As the bale is compacted by ram 16, it displaces the wires in the direction A of bale flow. Wire is paid out from each pair of spools until the material contacts a bale previously formed and tied in chamber 18. When the bale being compacted reaches a predetermined length, as indicated in conventional manner by a limit switch, pressure switch or counter, the ram 16 is advanced to and locked in a "bale tie" position against the bale. A bale tier 20 is then automatically operated to tie the bale as described in further detail hereafter. The tier 20 is controlled by a programmed controller in response to the output of the limit switch or other suitable sensor which detects the predetermined bale length. The programmed controller controls pressurized fluid flow to a set of vertically spaced hydraulic cylinders 22, 24, 26 via suitable hydraulic valving. The cylinders are part of automatic tier 20 and are activated either simultaneously or in any desired sequence set by programming the controller.

The bale tier 20 of the present invention includes separately operable modules 28, 30 and 32. The modules are identical and readily interchangeable. They are spaced in elevation on a door frame 34 which is pivotably secured to one side of the baling chamber 18 on a hinge pin 21. Thus, the door frame 34 may be swung away from the side of the baling chamber to permit manual tying of the bale wires and to facilitate access to and repair and maintenance of each module. The modules may be mounted on the door frame 34 on either side of the baling chamber as compared with prior art systems which utilize right or left handed automatic tiers, i.e. tiers which must be mounted only on one side or the other of the baling chamber.

Each module is slidably mounted on the door frame 34 so as to be adjustably pre-positioned in either of two directions independent of the positions of the other modules. Module 28 is slidably mounted on traverse or guide bars 36*a, b, c*. Module 30 is slidably mounted on traverse bars 38*a, b, c*. Module 32 is slidably mounted on traverse bars 40*a, b, c*. Thus, each module may be adjustably prepositioned by sliding the module along its associated traverse bars in the direction A (or the reverse direction) substantially parallel to the direction of bale flow. The module may then be secured in the desired position on the traverse bars by set screws or any other suitable means.

Each set of traverse bars is mounted in a pair of end blocks. Traverse bars 36*a, b, c* are mounted on end blocks 42*a, b*. Traverse bars 38*a, b, c* are mounted on end blocks 44*a, b*. Traverse bars 40*a, b, c* are mounted on end blocks 46*a, b*. Each end block is provided with a pair of pins which protrude through associated slots in frame 34. End block 42*a* is provided with a pair of pins 48, 50. End block 42*b* is provided with pins 52, 54. End block 44*a* is provided with pins 56, 58. End block 44*b* is provided with pins 60, 62. End block 46*a* is provided with pins 64, 66. End block 46*b* is provided with pins 68, 70. The pins associated with the end blocks ride in their associated frame slots. Each pin is threaded at its end so as to receive a lock nut. Thus, each module may be adjustably pre-positioned by sliding the module in a direction B (or the reverse direction) substantially perpendicular to the direction of bale flow. When a pair of end blocks is displaced in the direction B (or in the reverse direction) to the desired position, the lock nuts are tightened on the pins against frame 34 so as to secure the end blocks hence the module 28, 30 or 32 in the desired position.

Each cylinder 22, 24, 26 is mounted on a separate module and is movable with the module as the position of the module is adjusted in A or B (or reverse) directions as previously explained. Cylinder 22 is mounted on module 28. Cylinder 24 is mounted on module 30. Cylinder 26 is mounted on module 32. Each cylinder 22, 24, 26 is provided with a piston 72 which projects through the module associated with the cylinder in the direction A. A wire transport head 74 is mounted on each piston. The wire transport head is fastened to the piston and is provided with a nose portion 76 having a cam surface 78. The nose portion 76 is also tapered at sides 80, 82 to provide a clearance on each side of the head for twisting the wires carried by the head thereby forming a closed wire loop as described in detail hereafter. A pair of rollers 84, 86 are mounted on the head behind a shoulder 88 aft of nose portion 76. The tops of rollers 84, 86 are covered by a cover plate 89 secured to the wire transport head. The top of the cover plate is substantially flush with the uppermost portion of the nose portion 76.

Figure 5:
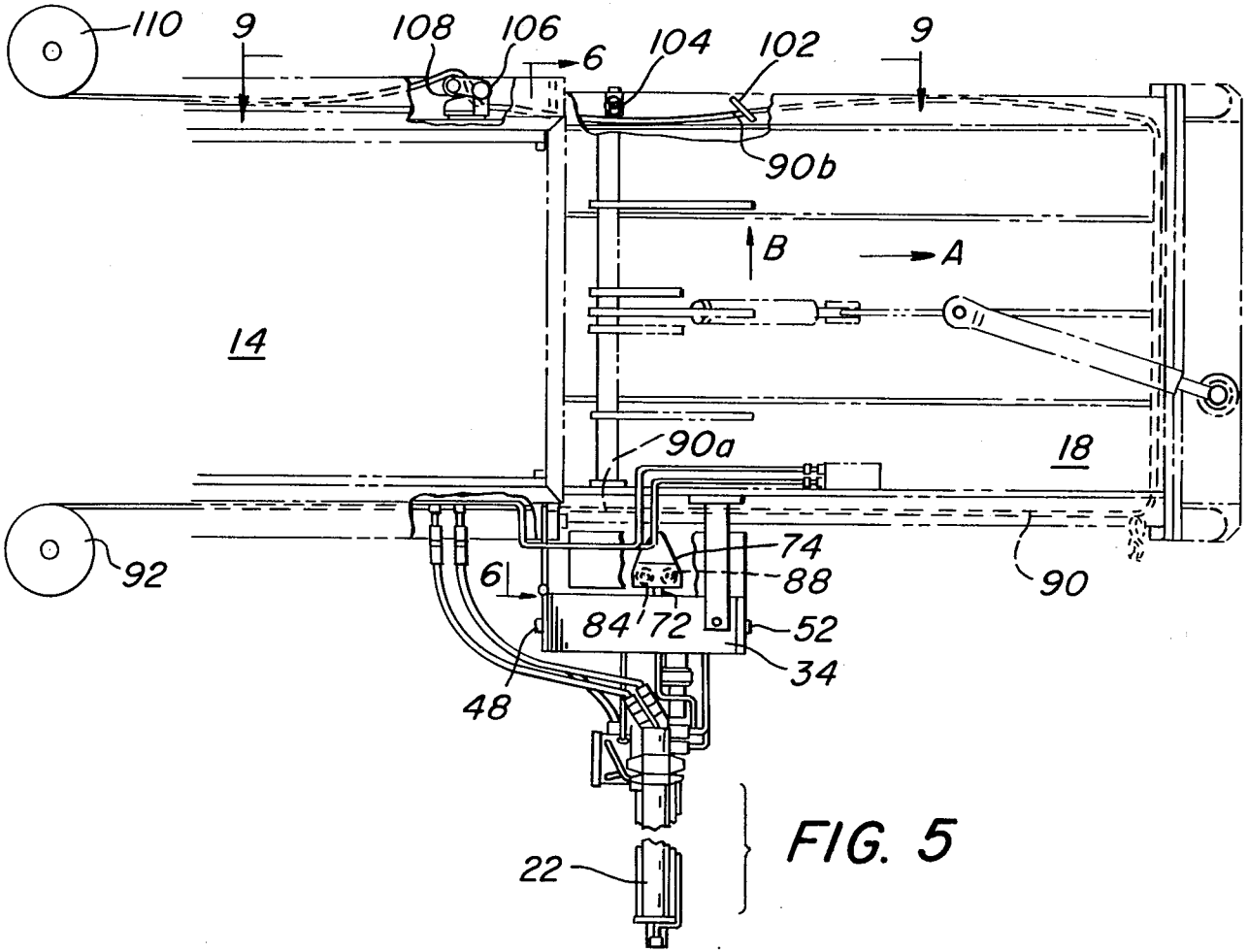
FIG. 5 is an enlarged top plan view of the bale tier shown in FIG. 4.
Figure 6:
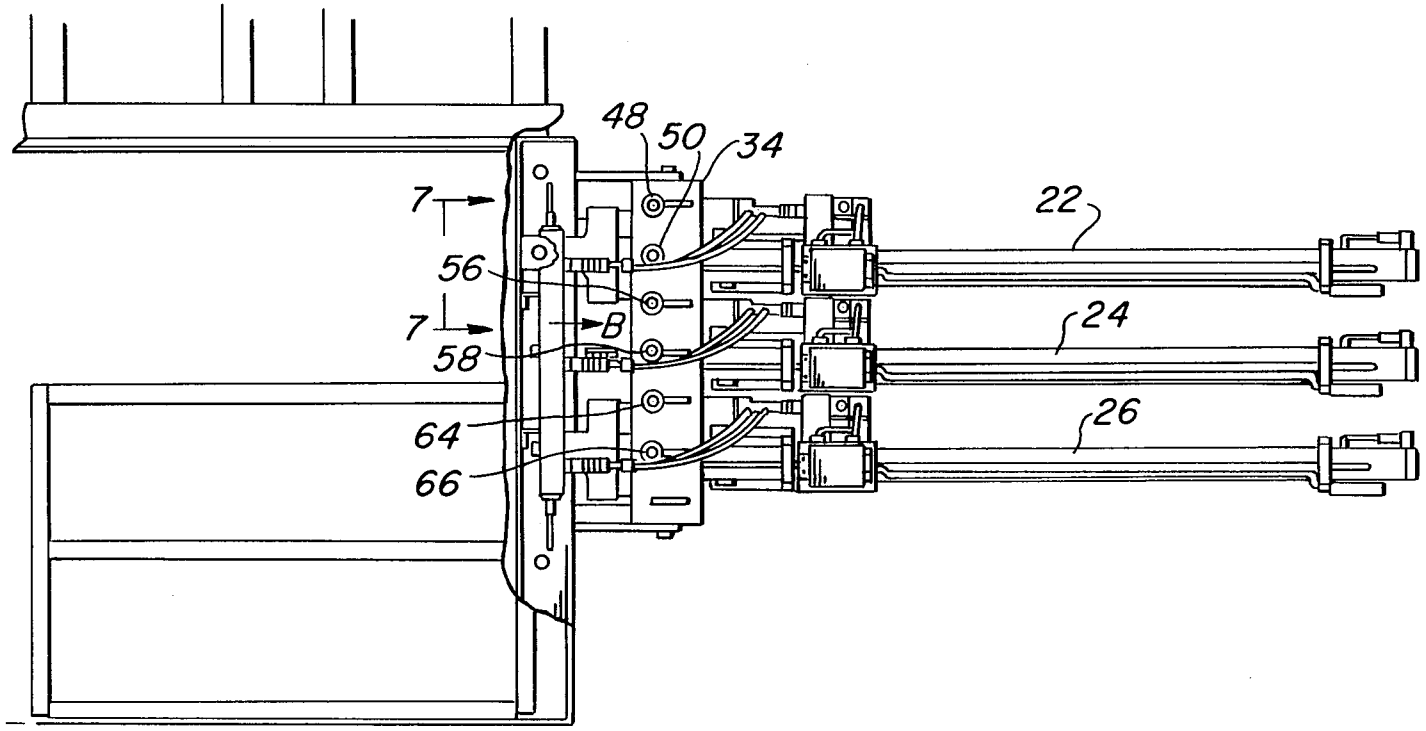
FIG. 6 is a section taken along 6—6 in FIG. 5.
Figure 7:
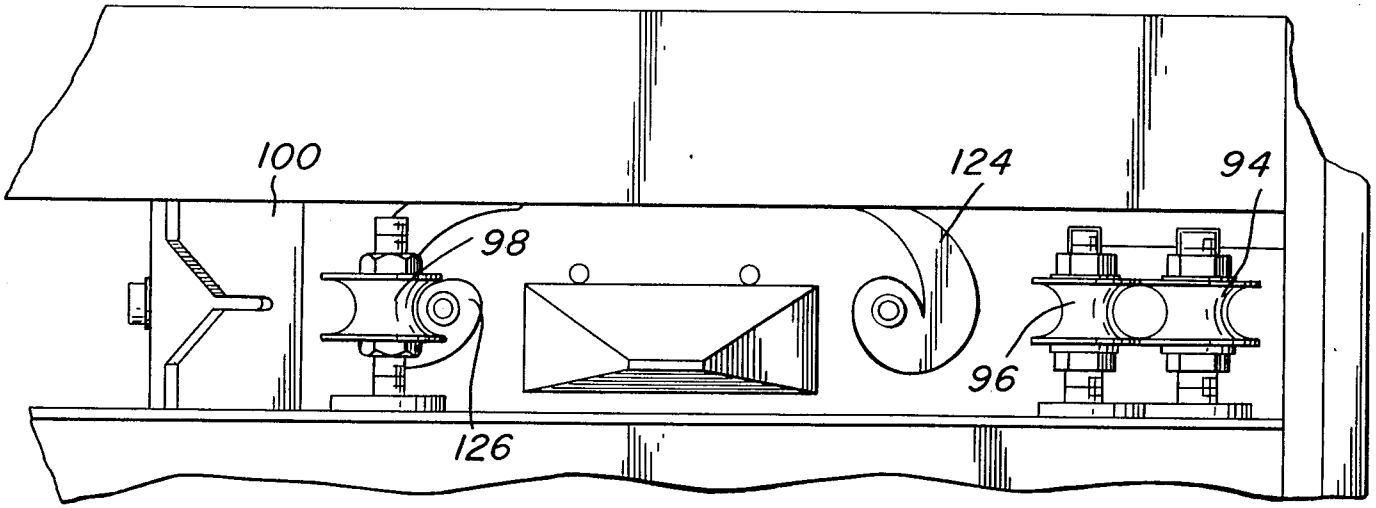
FIG. 7 is a partial section taken along 7—7 in FIG. 6.
Figure 8:
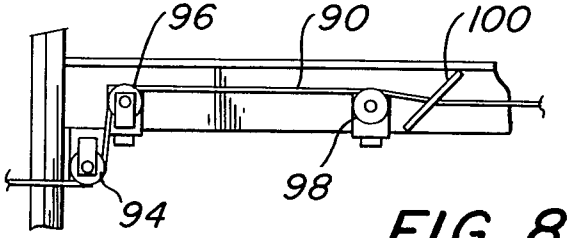
FIG. 8 is a partial section taken along 8—8 in FIG. 4.
Figure 9:
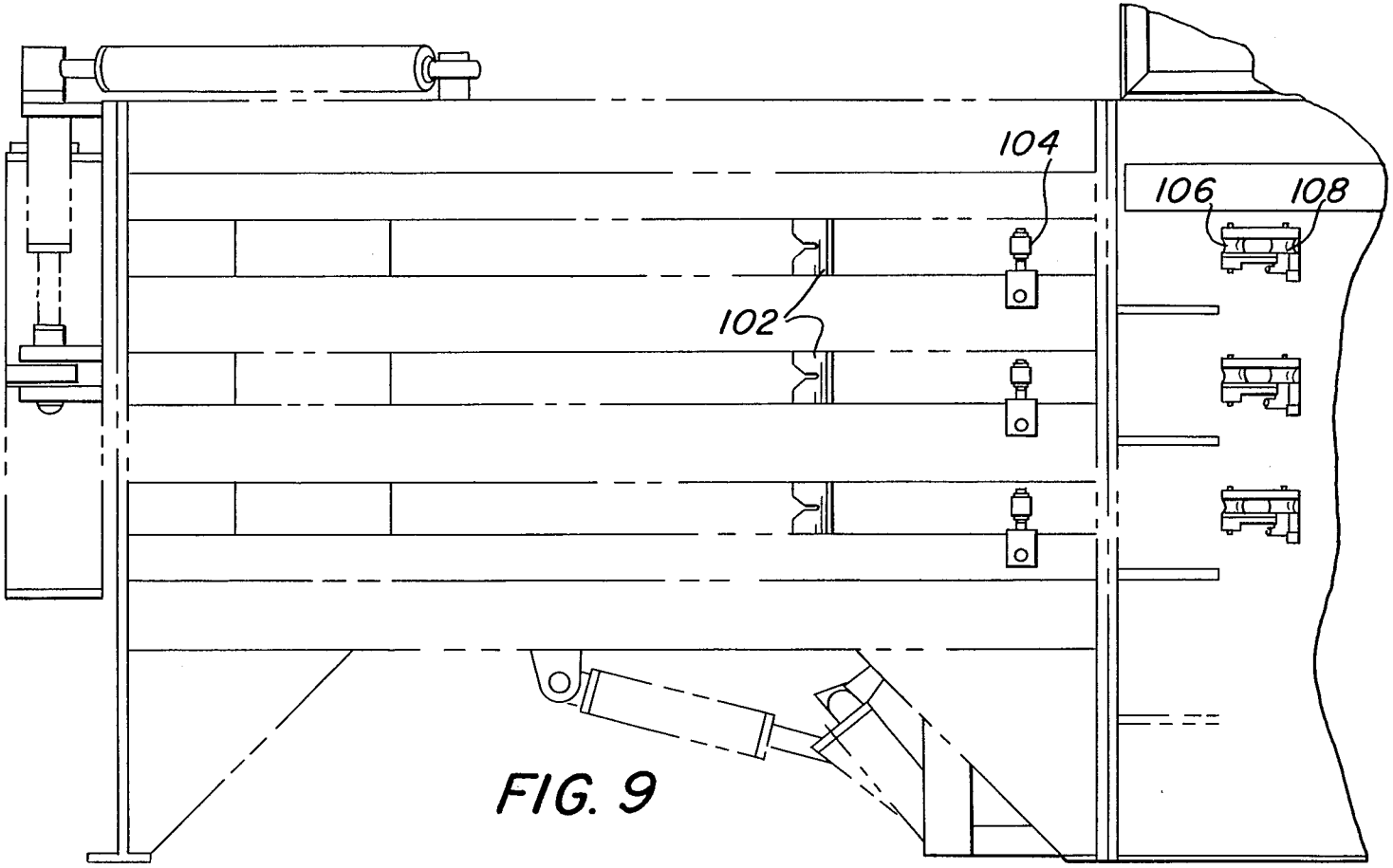
FIG. 9 is a section taken along 9—9 in FIG. 5.
Figure 10:
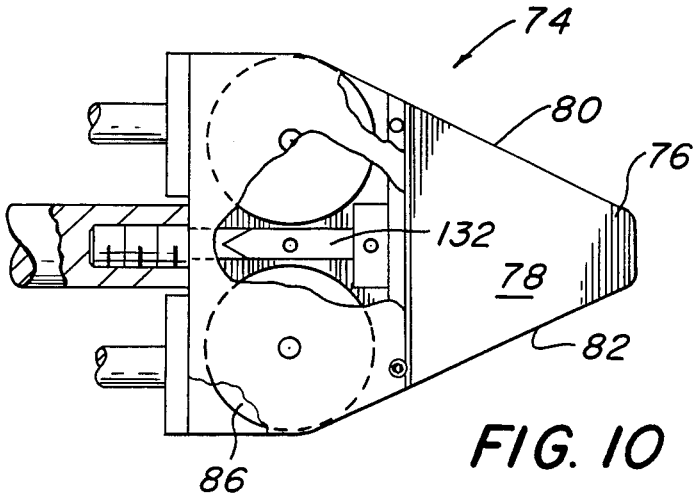
FIG. 10 is an enlarged top plan view of the wire transport head.
Figure 11:
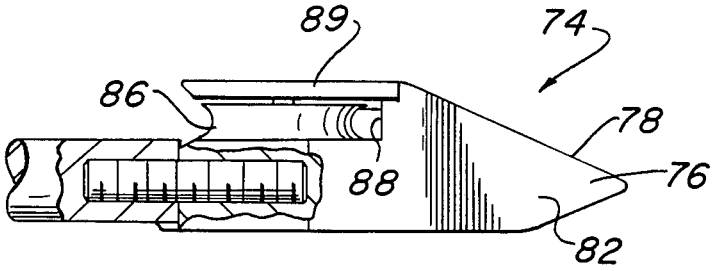
FIG. 11 is a side elevation of the wire transport head shown in FIG. 10.
Figure 12:
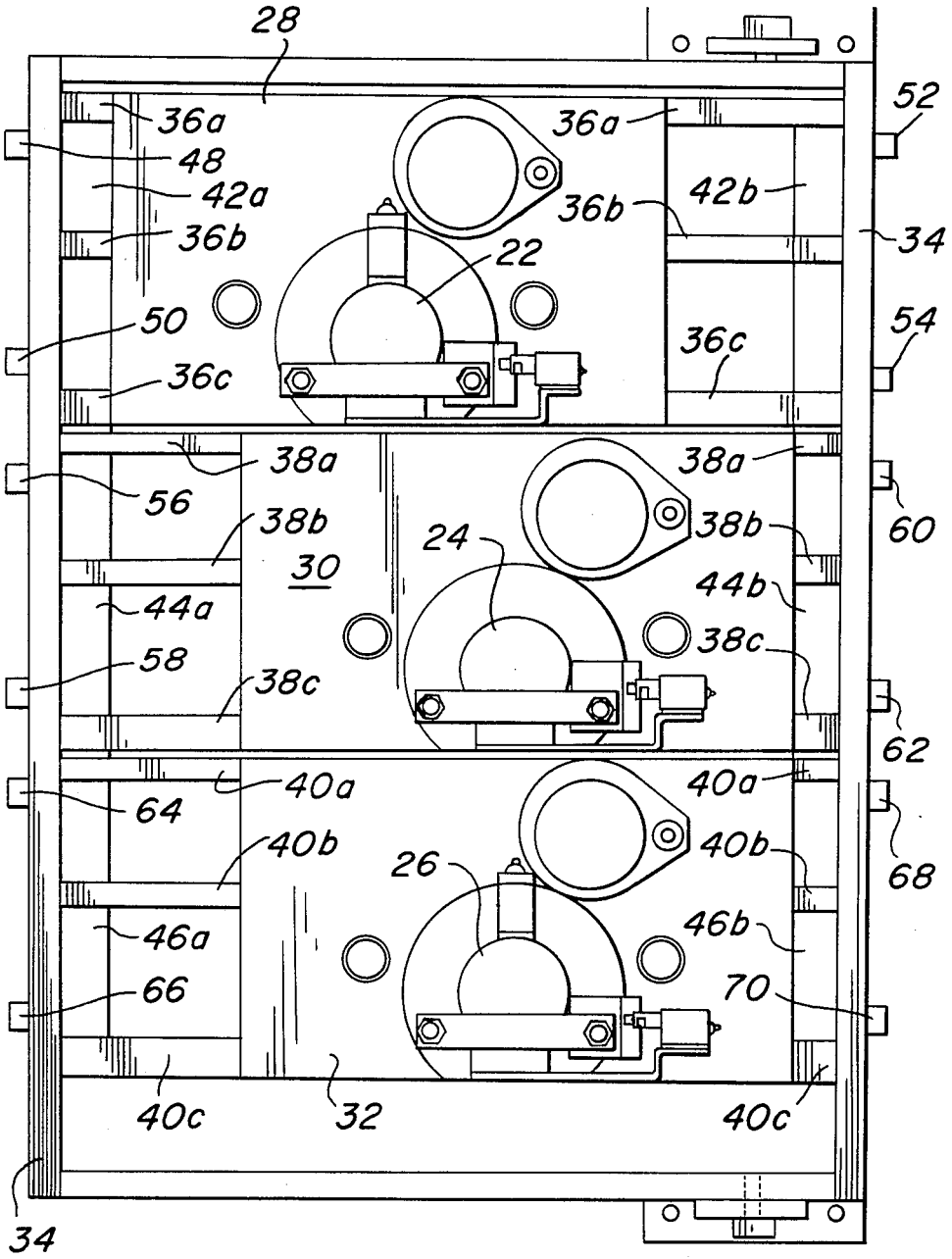
FIG. 12 is a side elevation of the baler modules showing adjustable positioning in the direction of bale flow.
Figure 13:
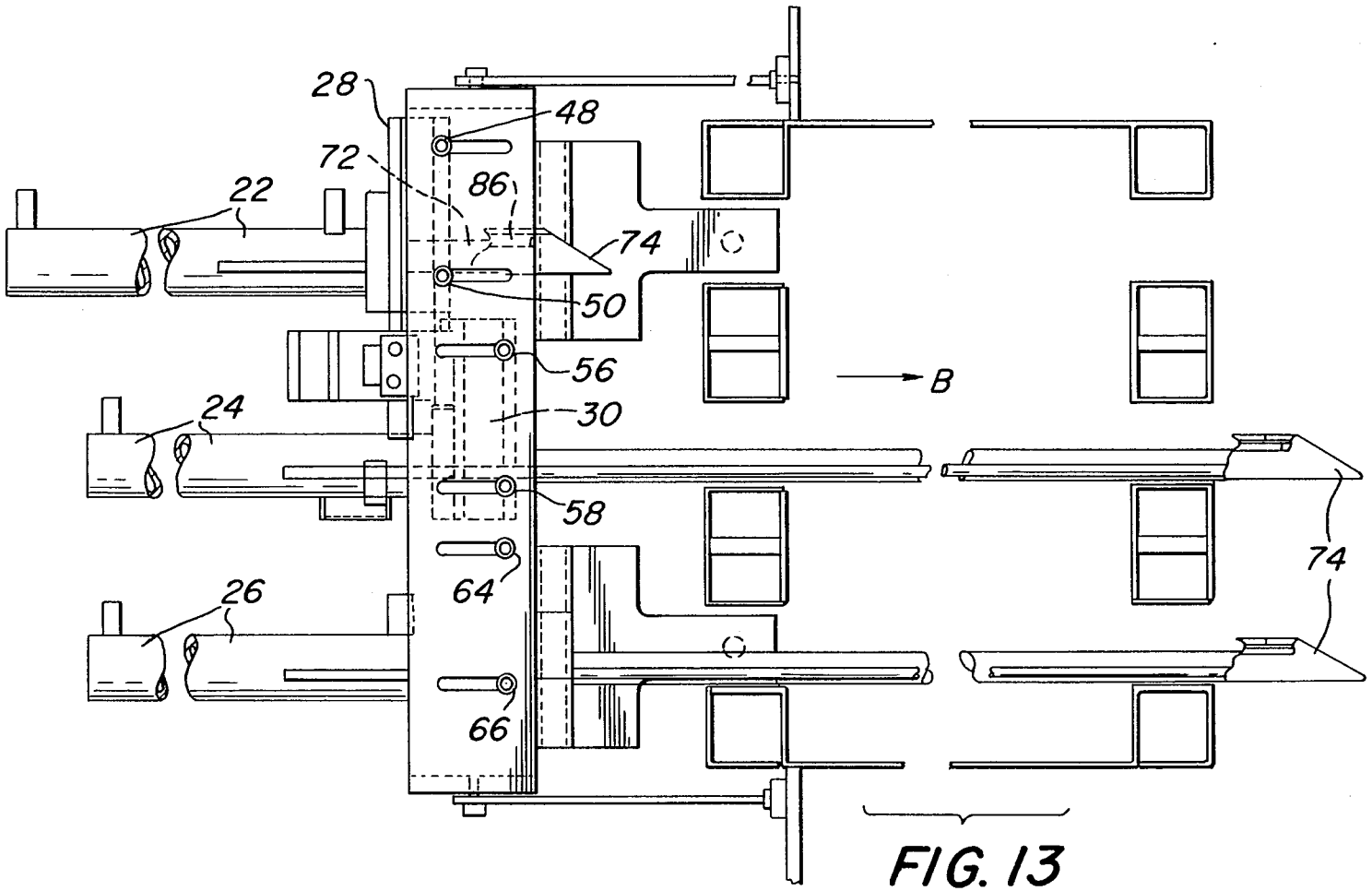
FIG. 13 is a side elevation of the baler modules showing adjustable positioning in a direction transverse to bale flow.
Figure 14:
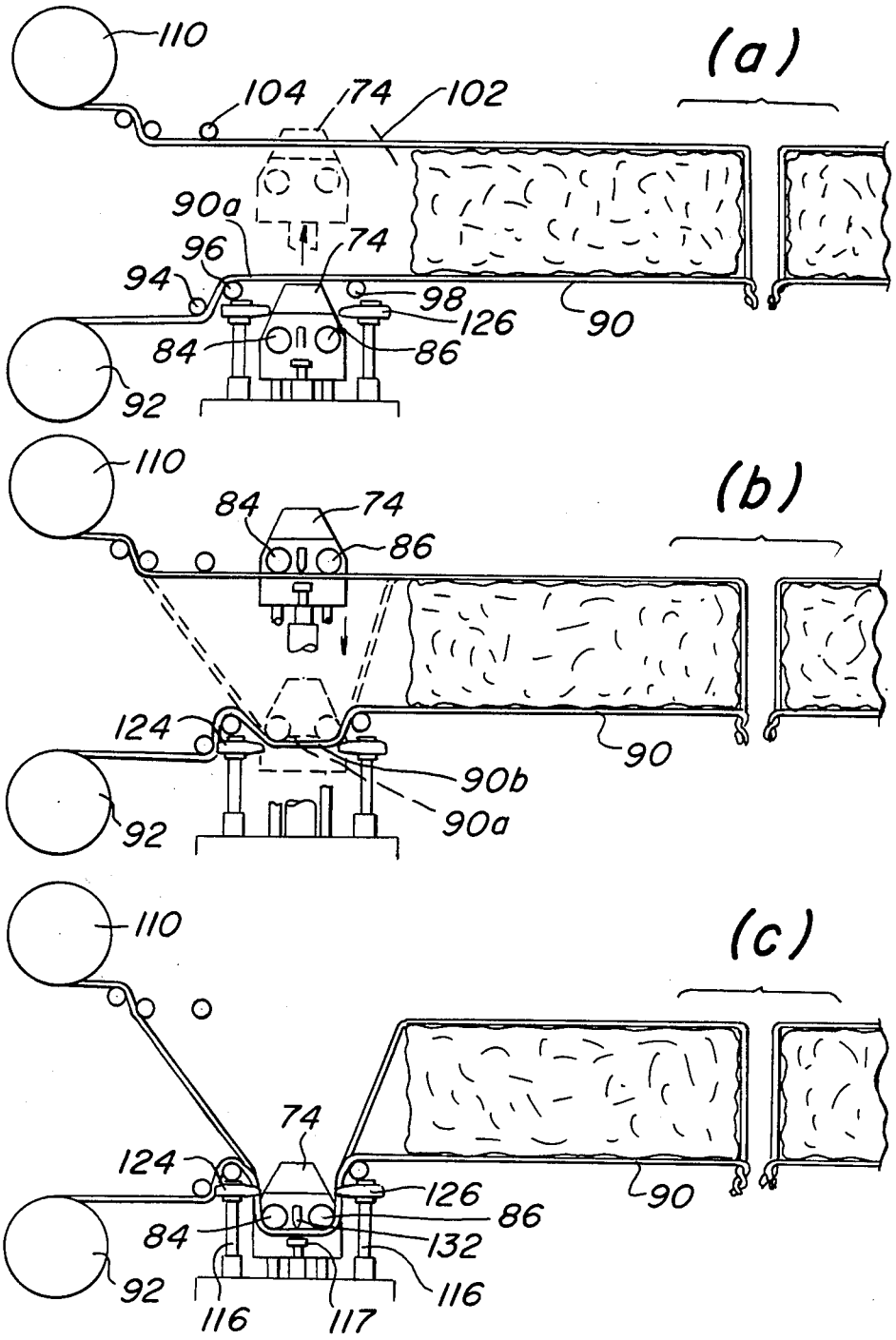
FIG. 14 is a schematic representation of the sequence of operation of the wire transport head.
Figure 15:
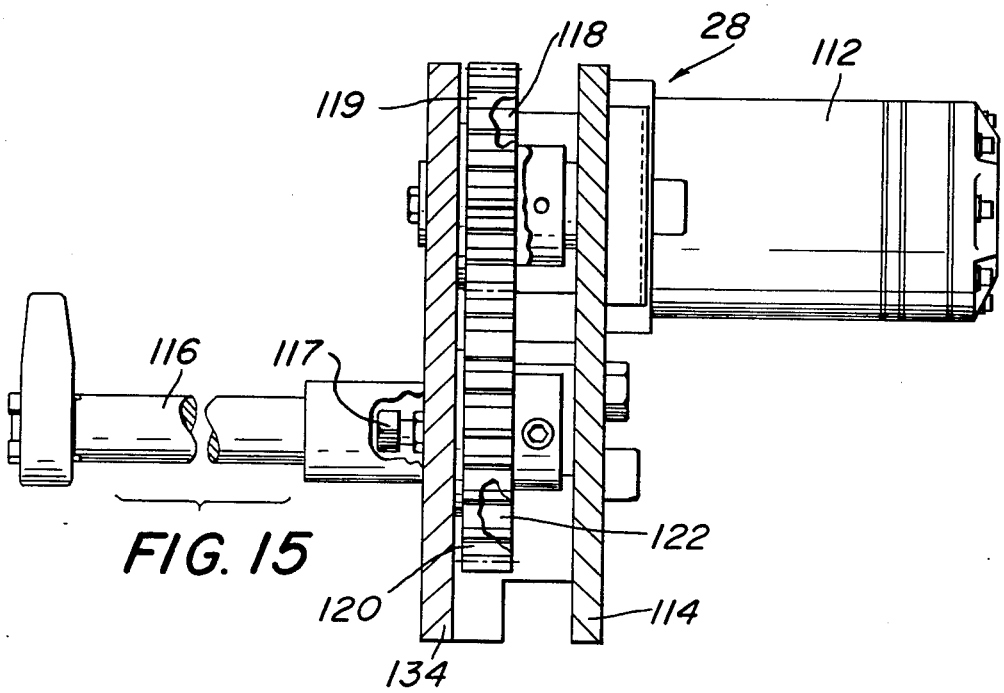
FIG. 15 is a side section of a baler module showing the wire twister drive mechanism.
Figure 16:
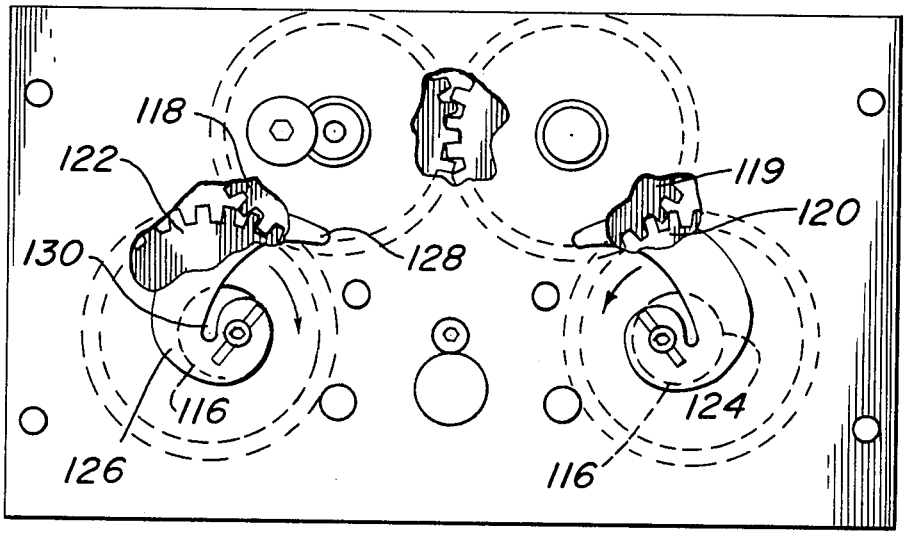
FIG. 16 is an elevation of a baler module showing the twister fingers.
Figure 17:
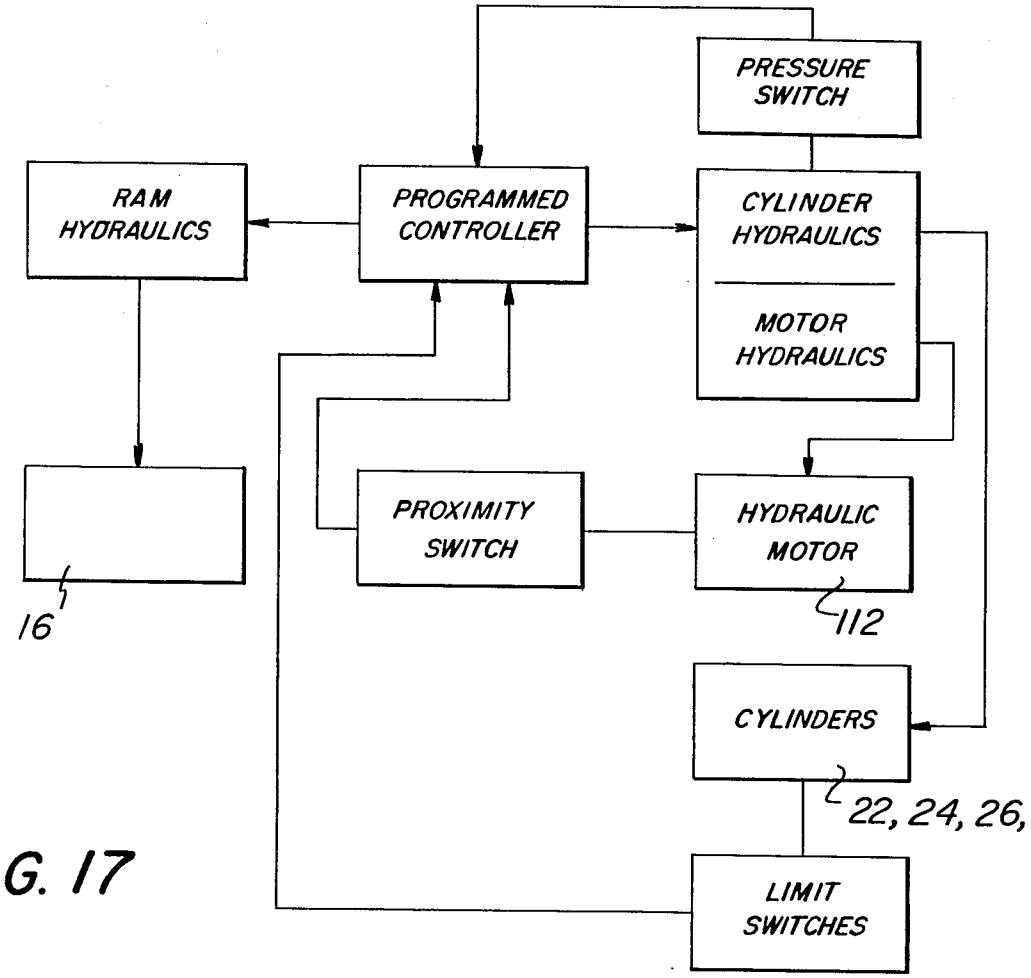
FIG. 17 is a schematic representation of a programmed controller and hydraulic for supervising operation of the automatic bale tier of the present invention.

In FIG. 5, the wire transport head 74 associated with module 28 is shown in the home position. Wire 90 extends between supply spools 92 and 110. The wire extends through a pair of tensioner rollers 94, 96, over a roller 98, through a wire guide 100, around the bale of compacted material in chamber 18, through a wire guide 102, over a roller 104, and through tensioner rollers 106, 108. Identical sets of rollers 94, 96, 98 and wire guide 100 are mounted on the side of baling chamber 18 proximal modules 28, 30, 32 at the elevation of each head 74. Similarly, identical sets of wire guide 102 and roller 104 are mounted on the side of baling chamber 18 opposite modules 28, 30, 32 at the elevation of each head 74. Identical sets of tensioner rollers 106, 108 are also mounted on the side of chamber 14 opposite modules 28, 30, 32 at the elevation of each head 74.

When the bale tier 20 is actuated by the programmed controller, module cylinders 22, 24, 26 may be operated simultaneously or in any desired sequence to tie their associated wires 90 in closed loops at different elevations around the compacted bale. All modules and cylinders being identical, description of module 28 and cylinder 22 will suffice.

Module 28 is first pre-positioned at the desired location with respect to chamber 18. The location corresponds to a desired length for the wire loop which is to be tied around the bale at the elevation of the wire transport head 74 associated with the module. Cylinder 22 is actuated so as to extend piston 72 and wire transport head 74 in the direction B. As the piston 72 and head 74 travel in the direction B, cam surface 78 on head 74 contacts wire portion 90*a*. The wire portion glides over the cam surface and cover plate 89 without being engaged by the rollers 84, 86. The piston 72 and wire transport head 74 then continue to move unobstructed through a port in the compaction ram 16 in the direction B. As previously indicated, the ram is provided with a port for each wire transport head and is locked in position as described in U.S. Pat. No. 3,528,364. The head exits the ram port and the cam surface 78 contacts wire portion 90b between wire guide 102 and roller 104. The wire portion 90b gluides over the cam surface 78 and cover plate 89. The wire portion 90b clears the rollers 84, 86 as the piston 72 reaches the end of its forward stroke in the direction B. The end of the forward stroke of the piston is detected in conventional manner by a limit switch connected to the controller. In response, the controller operates the cylinder hydraulic valving so as to retract piston 72 and therefore wire transport head 74 through the ram port. As the piston and wire transport head retract, rollers 84, 86 catch wire portion 90b. The wire transport head 74 carries the wire back through the ram port towards door frame 34 creating a lengthening bight in the wire. As the wire transport head 74 exists the ram port, the rollers 84, 86 catch the wire portion 90a extending between rollers 94, 96 and roller 98. The piston 72 continues to retract with both wire portions 90a and 90b now entrained on rollers 84, 86.

As the wire transport head nears the home position, its location is sensed by a limit switch connected to the programmed controller. In response, the controller operates cylinder 22, via the hydraulic valving, so as to stop the piston 72 hence head 74 before it reaches the home position. When the piston is stopped in advance of the home position, the wire portions 90a and 90b on each side 80, 82 of the head may be twisted together by twister fingers 124, 126. Each twister finger is mounted on one of a pair of shafts 116 for rotation with the shaft. The controller operates a hydraulic motor 112 via suitable hydraulic valving. The motor 112 is mounted on the rear plate 114 of module 28. The hydraulic motor drives shafts 116 through a predetermined number of revolutions. The shafts are driven in opposite directions via gearing 118, 119, 120, 122 mounted between the front plate 134 and rear plate 114 of the module 28. Each twister finger is provided with a tapered portion 128 and a notch 130 for capturing the wire portions 90a, 90b on each side of head 74. The wire portions 90a, 90b are generally parallel at the head sides 80, 82 and and the twister fingers 124, 126 are cleared for rotation therealong. The twister fingers 124, 126 are rotated a predetermined number of revolutions by motor 112 so as to create the desired number of twists on wire portions 90a, 90b on each side of the wire transport head. Each rotation of the finger shafts may be sensed by a proximity sensor associated with the shaft gearing and connected to the programmed controller. The controller counts the shaft rotations, based on the proximity sensor outputs until the desired number of rotations, corresponding to the desired number of twists, is attained. The controller then stops the motor 112. The number of twists may be changed separately for each wire loop by programming the controller. Thus, the number of twists for one wire loop may be the same as or different from the number for another wire loop.

The programmed controller then operates cylinder 22 so as to retract piston 72 towards the home position with the twisted wire portions 90a, 90b still entrained on rollers 84, 86 and retained on fingers 124, 126. As the piston retracts, a knife 132 fastened on head 74 between rollers 84, 86 contacts the wire portions 90a, 90b spanning the rollers against an anvil 117 bolted to the front plate 134 of module 28. The anvil 117 is bolted to the front plate between the shafts 116. As the knife severs the wire portions 90a, 90b, it contacts anvil 117 which prevents further motion of the piston and head. A pressure sensor detects a rise in fluid pressure at the cylinder due to the resistance to further retraction of the piston. The controller operates the cylinder hydraulics to stop cylinder 22 in response to the pressure switch output. The controller may then operate motor 112 so as to rotate fingers 124, 126 again to increase the number of twists, in the manner previously explained, until a total desired number of twists is attained. The controller then stops motor 112 and operates the motor in reverse for several shaft rotations to clear the wires from the fingers.

The foregoing cycle of operation is executed by each module, i.e. each cylinder, wire transport head, twister finger pair and knife, to separately tie closed wire loops are tied simultaneously or in any desired order under supervision of the programmed controller. The length of each wire loop is determined by the pre-positioning of the module associated with the loop and by the number of twists made by the module twister fingers. Since all modules are mounted in a single location on one side of the baling chamber, including the twisting and knife mechanisms, access for purposes of repair and maintenance is greatly simplified.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for tying bales of compacted material, comprising:

a frame, a module mounted on one side of the frame, said module including a wire transport head movable between a first position adjacent said one side of said frame and a second position adjacent an opposite side of said frame, means for guiding a wire having a first portion extending across a zone proximal said first position and a second portion extending across a zone proximal said second position, means for reciprocating said head between said first and second positions such that said head engages both wire portions, means for twisting and cutting said first and second wire portions engaged on said wire transport head to form a closed wire loop around said bale, and means for adjustably positioning said module with respect to said frame so as to adjustably predetermined the length of said closed wire loop.

2. Apparatus according to claim 1 wherein said wire transport head includes roller means for engaging said first and second wire portions as said head moves from said second position to said first position and a cam surface for cammingly contacting said first and second wire portions without engaging said wire portions as said head moves from said first position to said second position.

3. Apparatus for tying bales of compacted material, comprising:

a frame, two or more modules mounted on one side of the frame, each module including a wire transport head movable between a first position adjacent said one side of said frame and a second position adjacent an opposite side of said frame, means for guiding two or more wires each associated with one of said wire transport heads and having a first portion extending across a zone proximal said first position of the head and a portion extending across a zone proximal said second position of the head, means for separately reciprocating said wire transport heads between said first and second head positions such that each head engages both wire portions associated with the head, means for separately twisting and cutting said wire portions engaged on each of said wire transport heads to form two or more separate closed wire loops around said bale, and means for adjustably positioning said modules separately with respect to said frame so as to adjustably predetermine the length of each closed wire loop.

4. Apparatus according to claim 3 wherein said means for separately reciprocating said heads includes means for simultaneously reciprocating said heads between said first, and second, head positions.

5. Apparatus according to claim 3 wherein each wire transport head includes roller means for engaging said wire portions associated with the heads as the head moves from said second position to said first position and a cam surface for cammingly contacting said wire portions associated with the head without engaging said wire portions as said head moves from said first position to said second position.

6. Apparatus for tying bales of compacted material, comprising:

a frame, a module mounted on one side of the frame, said module including a wire transport head movable between a first position adjacent one side of said frame and a second position adjacent an opposite side of said frame, means for guiding a wire having a first portion extending across a zone proximal said first position and a second portion extending across a zone proximal said second position, means for reciprocating said wire transport head between said first and second positions such that said head moves from said first position to said second position and from said second position back to said first position, said wire transport head being provided with wire contacting means for contacting said wire portions without engaging the wire portions as said head is moved from said first position to said second position and wire engaging means for engaging the wire portions as said head is moved from said second position to said first position, and means for twisting and cutting said wire portions engaged by said wire engaging means at said first position of the head so as to form a closed wire loop around the bale.

7. Apparatus according to claim 6 including means for adjustably positioning said module relative to said one side of the frame so as to adjustably predetermined the length of said closed wire loop.

8. Apparatus according to claim 7 wherein said means for adjustably positioning said module includes means for adjustably positioning said module in either of two directions with respect to said frame.

9. Apparatus according to claim 1 or 6 wherein said means for twisting and cutting includes means for twisting said first and second wire portions engaged on said wire transport head and adjustable predetermined number of times.

10. Apparatus for tying bales of compacted material, comprising:

a frame, two or more modules mounted on one side of the frame, each of said modules including a wire transport head movable between a first position adjacent one side of said frame and a second position adjacent an opposite side of said frame, means for guiding two or more wires each associated with one of said wire transport heads and having a first portion extending across a zone proximal said first position of the head and a second portion extending across a zone proximal said second position of the head, means for separately reciprocating said heads between said first and second positions such that each head moves from the first position to the second position and from the second position back to the first position, each wire transport head being provided with wire contacting means for contacting said wire portions associated with the head without engaging the wire portions as said head is moved from said first position to said second position and wire engaging means for engaging said wire portions associated with the head as said head is moved from said second position to said first position, and means for separately twisting and cutting said wire portions engaged by said wire engaging means of said wire transport head at said first position of each head so as to form two or more separate closed wire loops around the bale.

11. Apparatus according to claim 10 wherein said means for separately reciprocating said heads includes means for simultaneously reciprocating said heads between said first and second head positions.

12. Apparatus according to claim 6 or 10 wherein said wire engaging means of a wire transport head includes roller means for rollably engaging said wire portions associated with the head and wherein said wire contacting means of the same wire transport head includes a cam surface for cammingly contacting the wire portions associated with the head.

13. Apparatus according to claim 10 including means for adjustably positioning said modules separately relative to said one side of the frame so as to adjustably predetermine the length of each closed wire loop.

14. Apparatus according to claim 13 wherein said means for adjustably positioning said modules separately includes means for adjustably positioning said modules separately in either of two directions with respect to said frame.

15. Apparatus according to claim 3 or 10 wherein said means for separately twisting and cutting includes means for separately twisting said wire portions on said wire transport heads a separately adjustable predetermined number of times for each head.

16. Method of tying bales of compacted material, comprising:

providing a wire transport head, providing a wire having a first portion adjacent one side of a bale and a second portion adjacent an opposite side of the bale, moving said wire transport head from a first position adjacent said one side of the bale to a second position adjacent said opposite side of the bale without engaging said wire portions, moving said wire transport head from said second position back to said first position and engaging said wire portions on said head, and twisting and cutting said first and second wire portions engaged on said head at said first position of the head so as to form a closed wire loop around said bale.

17. Method of tying bales of compacted material, comprising:

providing two or more wires each having a first portion adjacent one side of a bale and a second portion adjacent an opposite side of the bale, providing two or more wire transport heads each associated with one of said wires, separately moving each wire transport head from a first position adjacent said one side of the bale to a second position adjacent said opposite side of the bale without engaging said wire portions associated with the head and separately moving each wire transport head from said second position back to said first position and engaging on the head said wire portions associated with the head, and separately twisting and cutting said wire portions engaged on each wire transport head at said first position of the head so as to form two or more separate closed wire loops around the bale.

18. Method according to claim 17 including adjustably positioning each wire transport head separately before moving the head between said first and second head positions so as to adjustably predetermine the length of each closed wire loop separately.

19. Method of tying bales of compacted material, comprising:

providing a wire transport head, providing a wire having a first portion adjacent one side of a bale and a second portion adjacent an opposite side of the bale, moving said wire transport head between a first position adjacent said one side of the bale and a second position adjacent said opposite side of the bale and engaging said wire portions on the head, twisting and cutting said first and second wire portions engaged on said head so as to form a closed wire loop around said bale, and adjustably positioning said wire transport head before moving the head between said first and second positions so as to adjustably predetermine the length of said closed wire loop.

20. Method according to claim 19 wherein said step of moving said wire transport head includes moving the head from said first position to said second position without engaging said wire portions and moving the head from said second position to said first position and engaging said wire portions on the head.

21. Method of tying bales of compacted material, comprising:

providing two or more wires each having a first portion adjacent one side of a bale and a second portion adjacent an opposite side of the bale, providing two or more wire transport heads each associated with one of said wires, separately moving each wire transport head between a first position adjacent said one side of the bale and a second position adjacent said opposite side of the bale and engaging said wire portions on the head, separately twisting and cutting said first and second wire portions engaged on said heads so as to form two or more separate closed wire loops around said bale, and adjustably positioning each wire transport head before moving the head between said first and second head positions so as to adjustably predetermine the length of each closed wire loop separately.

22. Method according to claim 21 wherein said step of separately moving each wire transport head includes moving the head from said first position to said second position without engaging the wire portions associated with the head and moving the head from the second position back to the first position and engaging on the head the wire portions associated with the head.

23. Apparatus for tying bales of compacted material, comprising:

a frame, two or more modules mounted on one side of the frame, each module including a wire transport head movable between a first position adjacent said one side of said frame and a second position adjacent an opposite side of said frame, means for guiding two or more wires each individually associated with one of said wire transport heads and having a first portion extending across a zone proximal said first position of the head and a second portion extending across a zone proximal said second position of the head, means for separately and consecutively reciprocating said wire transport heads between said first and second head positions such that each head engages both wire portions associated with the head, means for separately twisting and cutting said wire portions engaged on each of said wire transport heads to form two or more separate closed wire loops around said bale, and means for adjustably positioning said modules separately with respect to said frame so as to adjustably predetermine the length of each closed wire loop.

24. Apparatus for tying bales of compacted material, comprising:

a frame, two or more modules mounted on one side of the frame, each of said modules including a wire transport head movable between a first position adjacent one side of said frame and a second position adjacent an opposite side of said frame, means for guiding two or more wires each individually associated with one of said wire transport heads and having a first portion extending across a zone proximal said first position of the head and a second portion extending across a zone proximal said second position of the head, means for separately and consecutively reciprocating said heads between said first and second positions such that each head moves from the first position to the second position and from the second position back to the first position, each wire transport head being provided with wire contacting means for contacting said wire portions associated with the head without engaging the wire portions as said head is moved from said first position to said second position and wire engaging means for engaging said wire portions associated with the head as said head is moved from said second position to said first position, and means for separately twisting and cutting said wire portions engaged by said wire engaging means of said wire transport head at said first position of each head so as to form two or more separate closed wire loops around the bale.

25. Method of tying bales of compacted material, comprising:

providing a wire transport head, providing a wire having a first portion adjacent one side of a bale and a second portion adjacent an opposite side of the bale, adjustably positioning wire transport head before moving the head between first and second positions so as to adjustably predetermine the length of a closed wire loop to be formed around said bale, moving said wire transport head from said first position adjacent said one side of the bale to said second position adjacent said opposite side of the bale without engaging said wire portions, moving said wire transport head from said second position back to said first position and engaging said wire portions on said head, and twisting and cutting said first and second wire portions engaged on said head at said first position of the head so as to form a closed wire loop around said bale.

* * * * *